US007030397B2

(12) United States Patent
Mezei et al.

(10) Patent No.: US 7,030,397 B2
(45) Date of Patent: Apr. 18, 2006

(54) NEUTRON-OPTICAL COMPONENT ARRAY FOR THE SPECIFIC SPECTRAL SHAPING OF NEUTRON BEAMS OR PULSES

(75) Inventors: Ferenc Mezei, Berlin (DE); Margarita Russina, Los Alamos, NM (US)

(73) Assignee: Hahn-Meitner-Institut Berlin GmbH, Berlin (DE)

( * ) Notice: Subject to any disclaimer, the term of this patent is extended or adjusted under 35 U.S.C. 154(b) by 0 days.

(21) Appl. No.: 10/502,372

(22) PCT Filed: Jan. 22, 2003

(86) PCT No.: PCT/DE03/00192

§ 371 (c)(1),
(2), (4) Date: Jul. 23, 2004

(87) PCT Pub. No.: WO03/063183

PCT Pub. Date: Jul. 31, 2003

(65) Prior Publication Data

US 2005/0157831 A1 Jul. 21, 2005

(30) Foreign Application Priority Data

Jan. 23, 2002 (DE) ..... 102 03 591

(51) Int. Cl.
*G21K 1/06* (2006.01)

(52) U.S. Cl. ..... 250/505.1; 250/251

(58) Field of Classification Search ..... None
See application file for complete search history.

(56) References Cited

U.S. PATENT DOCUMENTS 5,920,601 A * 7/1999 Nigg et al. ..... 376/194
5,949,840 A * 9/1999 Greene ..... 250/505.1
6,580,080 B1 * 6/2003 Shimizu et al. ..... 250/505.1
6,895,064 B1 * 5/2005 Ritter ..... 376/194

FOREIGN PATENT DOCUMENTS

DE 029716107 U1 * 10/1997

OTHER PUBLICATIONS

Watanabe, N.: "5.3 Material Issues for Spallation Target by GeV Proton Irradiation"; Center for Neutron Science, Japan Atomic Energy Research Institute, Tokai-mura, Naka-gun, Ibaraki-ken, 319-1195 Japan.
Alonso, Jose R.: "The Spallation Neutron Source Project"; Proceedings of the 1999 Particle Accelerator Conference, New York, 1999.
Filges, D., et al.: Particle Transport Simulation of the Neutronic Performance of Moderators of the ESS Mercury Target-Moderator-Reflector Systemn.

* cited by examiner

*Primary Examiner*—Jack I. Berman
(74) *Attorney, Agent, or Firm*—Karl Hormann

(57) ABSTRACT

A neutron-optical component array in which the beam paths of the individual moderators are combined in a concerted manner so as to create a superimposed neutron beam with an effective mean beam direction. The superimposed neutron beam has a multi spectrum composed of the single spectrums of several moderators, whereby a larger spectral width is obtained, making various applications in different neutron energy fields possible. The multi spectrum can be further improved in terms of the intensity thereof and the beam quality by adding further neutron-optical components, particularly in the form of an energy-depending switching super reflector, and by switching between moderators.

8 Claims, 1 Drawing Sheet

Figure 1:
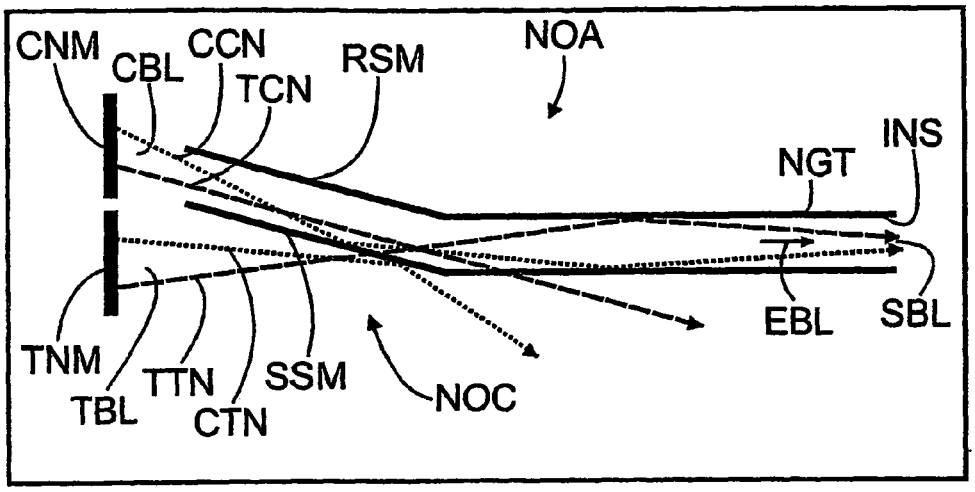

NEUTRON-OPTICAL COMPONENT ARRAY FOR THE SPECIFIC SPECTRAL SHAPING OF NEUTRON BEAMS OR PULSES

BACKGROUND OF THE INVENTION

1. Field of the Invention

The invention relates to a neutron-optical component array for the specific spectral shaping of neutron beams or pulses in a neutron guide or beam hole between a fast neutron source with several moderators of different structures arranged closely adjacent each other for generating slow neutrons of different energy spectra as well as for their radiation in predetermined radiation directions and to at least one place of experiment.

2. The Prior Art

Neutron beams serve in a broad spectrum of scientific examinations ranging from pure basic science to application-related examinations in the field of research of the structure of matter. Here, neutrons function quasi as sensors which penetrate into the matter. Neutrons impinging upon atoms of structured matter are either scattered in a manner characteristic of the atoms or they are absorbed by the atoms by emitting characteristic radiation. For most applications, as for instance in neutron scattering, it is necessary to provide slow neutrons which are generated by deceleration of fast neutrons obtained from nuclear reactions. Intensive neutron radiation of fast neutrons is primarily generated in research reactors either by splitting enriched uranium in a temporally constant flow or as pulses in spallation sources by crushing heavy atoms.

The specific deceleration of fast neutrons is primarily carried out by so-called "moderators" which are brought into contact with the fast neutron radiation. Stated in simple terms, these are collections of matter of gaseous, liquid or solid appearance which, at a predetermined temperature, have specific characteristics. By the interaction of fat neutrons with the preferably light atoms of the moderator matter, the high energetic neutrons are strongly decelerated to the point where their energies and wavelengths are of the requisite values for experiments with condensed matter. A neutron gas of kinetic energy distribution is produced which at a given temperature may be approximated by a Maxwellian velocity distribution. This is a theoretically derived function which assigns their relative abundance to the velocities of the atoms of a gas. The effective temperature of the Maxwellian spectrum of the neutron gas is somewhat higher, however, than the temperature of the moderator matter. In this connection it is to be mentioned that neutron reflectors such as, for instance, (heavy) water, lead, beryllium, graphite, etc. also generate slow neutrons, but with a spectrum different from the spectrum which may be approximated by the Maxwell spectrum. Nevertheless, reflectors which serve primarily to increase the flow of neutrons also contribute to neutron-deceleration, so that, in a broader sense, they may, as neutron-optical components, be grouped with the moderators. Premoderators such as water and all other structures of a neutron sources capable of emitting slow neutrons may also be counted among the group of moderators.

Depending upon the temperature of the moderator material, slow neutrons are differentiated between "hot", "thermal", and "cold" neutrons, so that the moderators may also be distinguished as "hot", "thermal", and "cold" moderators. In the present context, slow neutrons are those of a kinetic energy in the range of 1 eV and less. The energy of hot neutrons of higher velocity and lesser wavelength is in a range above 100 meV and are particularly suitable for scatter experiments with liquids. Thermal neutrons are of a kinetic energy in the range of between 10 meV and 100 meV, and the kinetic energy of cold neutrons lies in the range between 0.1 meV and 10 meV. Cold neutrons of relatively low velocity and large wavelength are above all of importance for applications of neutron scattering for examining biological substances. Depending on the kind of their primarily generated slow neutrons, a distinction is made between hot, thermal and cold moderators. A survey of possible moderator structures in a spallation source may be derived from paper I "Particle Transport Simulations of the Neutron Performance of Moderators of the ESS Mercury Target-Moderator-Reflection System" (downloadable from the Internet at http://www.hmi.de/bereiche/SF/ess/ESS_moderators3.pdf, state 18 January 2002). Examples thereof are the liquid hydrogen moderator with an operating temperature in the range of 25° K for generating cold neutrons and the water moderator using the ambient temperature as its operating temperature for generating thermal neutrons. However, a cold moderator also generates thermal and hot neutrons as well, and a thermal moderator also generates cold and hot neutrons, but always at a flow lower by an order of magnitude than the moderator which serves for generating primarily cold, thermal or hot neutrons.

To provide the correct required neutron spectrum for different experiments with slow neutrons, the known neutron sources operate with a combination of different moderators. From Paper II "The Spallation Neutron Source Project" by Jose R. Alsonso; Proceedings of the 1999 Particle Accelerator Conference, New York, 1999, pp. 574–578, (downloadable from the Internet at http://accelconf.web.cem.ch/accelconf/p99/PAPERS/FRAL1.pdf—(State 18. January 2002), it is known to position two water moderators tempered by room temperature below the level with the target material to be crushed and two super-critical hydrogen moderators with an operating temperature of 20° K above the target plane. Each moderator exclusively provides one or more of eighteen places of experiment with the slow neutron spectrum generated by it (see FIG. 9 and Chapter 6 of Paper II). A similar structure is also known from Paper III "5.3—Material Issues for Spallation Target by GeV Proton Irradiation" by W. Watanabe (downloadable from the Internet at http://www.ndc.tokai.jaeri.go.jp/nds/proceedings/1998/watanabe_n.pdf; state 18 January 2002). It describes a target-moderator-configuration for executing high intensity and high resolution experiments with cold neutrons, in which a coupled cold moderator with a premodulator and two thermal moderators are arranged closely adjacent the target in the region of the highest and fastest neutron radiation (see Paper III, Chapter 4 (2) to (4) and FIG. 2). As an important point, the paper refers to the close proximity notwithstanding, cross-talk between the individual moderators which effects the neutron intensity, can be prevented (see Paper III, Chapter 4 (ii)). For that reason, the moderators are arranged relative to each other at such angles that their forward and rearward radiation directions or emitted neutron beams are oriented in different spatial directions without overlapping each other. In this manner, each moderator supplies about four to eight places of experiment with a neutron beam of characteristic spectrum. Moreover, reflectors are arranged between the to levels for separating the spectra.

Proceeding from the known state of the art relating to the known application of moderators as described, for instance, in previously cited Paper III, it can be recognized that the provision of a neutron spectrum of slow neutrons required for a specific experiment as well as the generation thereof causes significant problems. In particular, with regard to the very complex and expensive structures of the neutron-optical components as well as the high protective measures which they require, the state of the art knows of no neutron spectrum for a single place of experiment. Each place is supplied with a neutron spectrum the maximum of which indicates the principally generated slow neutrons, from a directly associated moderator type. Changes in the spectrum of the neutron beam at a place of experiment may be realized only by significant structural changes in the structure of the moderator at extended down-times of the neutron source. Experiments in energy ranges broader than the one of a single slow neutron form are not possible or they are very inefficient.

OBJECTS OF THE INVENTION

For that reason, it is an object of the invention to provide an array of neutron-optical components for the specific shaping of the spectrum of a neutron beam of the kind referred to supra which offers significant flexibility in respect of providing one neutron beam to one place of experiment, so that no extensive structural changes are required in case of change requirements. More particularly, experiments with neutrons from a larger energy range are to be made possible as well. Furthermore, the neutron beam provided by the invention is to be of high quality. The means for realizing the invention are to be simple in their structure and operation and, therefore, subject to relatively few malfunctions as well as low costs. Present aspects of safety are to be taken into consideration and additional risks are to be avoided.

BRIEF SUMMARY OF THE INVENTION

In the accomplishment of this object the invention provides in a neutron-optical component array for the specific shaping of neutron beams or pulses of the kind described hereinbefore for the radiation directions of the moderators to overlap directly or by further neutron-optical components in the neutron guide or at the place of experiment and for the slow neutrons of different energy spectra in an overlapping neutron beam be detected together with a multi-spectrum which is defined by the structure and number of moderators used.

The energy spectra of different moderators are combined into a "multi-spectrum" by the neutron-optical component array in accordance with the invention. A neutron beam (or a neutron pulse—this alternative is always to be included when the term "neutron beam" is used) with such a multi-spectrum may be used in many different applications. As it has a broader energy spectrum than the individual neutron beams generated by a moderator, the overlapping neutron beam in accordance with the invention makes possible neutron experiments with high efficiency in a broad energy range of the impinging neutrons, e.g. between 0.1 meV and 100 meV. The composition of the multi-spectrum of the overlapping electron beam depends upon kind and number of moderators used. For instance, a cold and a thermal moderator or a cold, a thermal, and a hot moderator may be combined in their direction of propagation. In the same manner, different designs of a type of moderator may be combined to achieve a particularly broad multi-spectrum or a specially-formed multi-spectrum in terms of its emission. The combination of different modulators is limited only by structural restraints since in terms of apparatus technology the combination of the radiation direction must be realizable with a reasonable effort. In this connection, mention is to be made that other neutron-optical components present in the neutron system as well as parts of the neutron source itself may, of course, be included in the composition of the multi spectrum, with other main functions which provide for a decelerating effect on the neutrons, such as reflectors, neutron guides, and primary moderators, by combining the emitted radiation into the common neutron beam. This results in a single or multiple overlapped neutron beam for many different applications. The point of gravity of the invention resides in the combination of the individual neutron beams in a common neutron beam with a correspondingly broadened energy spectrum. Heretofore, the prior art has always proceeded from an express and deliberate separation of the effective ranges of the moderators since this seemed to be the only possibility without much effort to provide suitable slow neutron beams for yielding usable measurement results. The disadvantage of the low flexibility was accepted and corresponding numbers of places of experiment were conceived.

The overlapping of the individual neutron beams from the moderators used to a common neutron beam may take place in the neutron guide as well at the place of experimenting. The first case results in the formation of a neutron beam which like a single electron beam is conducted in one neutron guide to the place of experiment and to the probe. In the second case, the different neutron beams are focused on the probe to be examined so that the overlapping neutron beam impinges directly on the probe. The advantage of this overlapping irradiation at the place of experiment itself resides in the relatively low technical complexity for combining the directions of radiation of the individual moderators. In the simplest case, the adjacent moderators are to be arrayed relative to each other at such angles that it results in a focal point of the radiation directions in the probe or slightly in front thereof. In a further development of the neutron-optical component array in accordance with the invention the radiation directions may, in case they overlap directly, be detectable at the place of experiment by a predetermined encoding scheme. In terms of the measurement results it may be important to know the different radiation directions from which the different kinds of neutrons impinge upon the probe. In a pulsed neutron source this may be carried out by monitoring the neutron flight time. In case of a it is necessary to chop the neutron beam correspondingly. Since within the slow neutrons, the cold, thermal, and hot neutron differ by the energy spectrum and, hence, by their velocity distribution, knowledge of the individual neutron flight times makes possible, on the basis of the pulses, an association to the individual moderators and, therefore, with their radiation direction relative to the probe.

However, for the majority of applications in experiments it is important that all the neutron from a common spatial direction impinge upon the probe to be examined. This common spatial direction will hereafter be denominated "effective mean beam direction". To achieve a common beam direction overlapping of the individual neutron beams by further neutron-optical components is necessary. Different components are known for the specific control of the neutron beams, all of which are suitable in the array in accordance with the invention to bring about a combination of the emissions of the moderators. Among these is the neutron guide itself which in accordance with one embodiment of the invention may on its interior surface be plated with nickel (se German patent specification DE 44 23 781

A1) and which reflects neutron impinging at predetermined especially flat angles into the interior of the tube. If two neutrons impinge the input section of the neutron guide from two different directions, for instance, they will be steered into the desired effective mean beam direction during the course of the neutron guide by the internal reflection thereof.

Furthermore, in an overlapping of the radiation directions by further neutron-optical components for achieving an effective mean beam direction of the overlapping neutron beam, a further embodiment of the invention may provide for a further neutron-optical component structured as an oscillating reflector which oscillated in synchronism with a pulsed neutron source or with the chopped neutron beam of a continuous neutron source. The oscillating reflector causes the neutron beams from different moderators to be alternatingly inserted into the overlapping neutron beam with the effective mean beam direction. If, for instance, the reflector oscillates to and fro between a cold and a thermal moderator at the beat rate of a neutron pulse source and if its angle is proper in respect of the impinging cold neutrons, it will initially reflect the cold neutron pulse into the means radiation direction. Thereafter, the angle of the reflector is changed at the beat rate of the pulse so that thermal neutrons will impinge and the thermal neutron pulse is coupled in. The respective other neutron pulse will be deflected outside of the mean radiation direction. At a continuous neutron beam from a core reactor mechanical or chopper arrangements operating differently may be used for chopping the continuous neutron beam into individual pulses. In such an embodiment, measurements at the probe are to be carried at the beat rate of the neutron pulses or of the oscillator.

It has already been mentioned supra that in the energy spectra of the individual moderators two marginal areas with neutron energies occur which are mainly generated by the other moderators. If in an experiment only cold neutrons have been fed to a probe, hot and thermal neutrons will nevertheless be present in the neutron beam, yet at a significantly lower quantity. In accordance with a further embodiment of the neutron-optical component array in accordance with the invention it is particularly advantageous to provide a further neutron-optical component with an energy depending switching function. In this variant of an embodiment, there is no active moving reflector switching back and forth between individual neutron beams, but a neutron-optical system is provided instead which simultaneously captures all impinging neutron. In this connection a neutron-optical component is used which is provided with an energy-selective switching function. Such components may be structured and aligned so that they pass, for instance, the central energy range of each moderator with the greatest quantity of the neutrons to be generated and couple them into the effective mean radiation direction. By contrast, they block the marginal areas with the energetically diverging neutrons. The multi spectrum of the overlapping neutron beam may be combined by the switching function by passing for the individual kinds of neutrons the corresponding neutrons from the moderators which generate them. It is thus possible for cold as well as for thermal and hot neutrons to attain a maximum neutron flow for the experiments.

Neutron-optical components with an energy-selective switching function may be realized primarily by special neutron reflectors. For that reason, a further embodiment of the invention provides for the further neutron-optical component with an energy-depending switching function to be structured as a neutron reflector which continuously or intermittently passes or blocks impinging neutron by a corresponding angular alignment depending upon their energy. For further explaining the functional cooperation of the neutron reflectors, to achieve the switching action described above, reference may be had, for the sake of avoiding repetition, to the particular section of this specification. In accordance with a further embodiment of the invention, the neutron reflectors may advantageously be structured to be self-supporting or as being applied on a neutron-transparent substrate as a single layer or multi-layered reflector, with the coating being applied to one or both sides of the substrate. The multi-layered neutron reflectors are so-called "super-reflectors" with interfering properties (see German patent specification DE 198 44 300 A1). For instance, silicon and sapphire are suitable substrates. All of these neutron-optical components are of relatively simple structure and are thus inexpensive compared to other neutron-optical components. A particularly advantageous and compact structure of the invention results in accordance with another embodiment by integrating the further neutron-optical components with an energy-depending switching function into the neutron guide. As regards this embodiment, reference may be had, for the sake of avoiding repetition, to the specific portion of the description.

DESCRIPTION OF THE SEVERAL DRAWINGS

Figure 2:
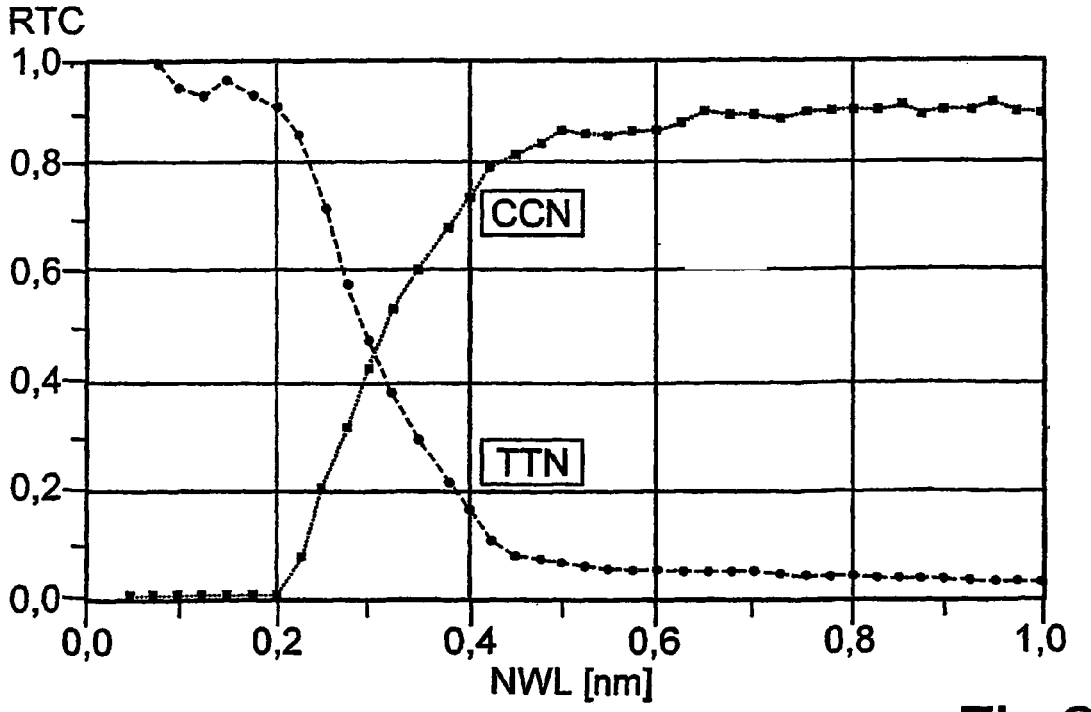

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

FIG. 1 depicts a neutron-optical component array for generating a multi spectrum; and FIG. 2 depicts the switching function provided by the system of FIG. 1 for generating a multi spectrum.

DETAILED DESCRIPTION OF THE PREFERRED EMBODIMENTS

FIG. 1 depicts the neutron-optical component array NOA for the specific spectral shaping of neutron beams or pulses. In the selected embodiment a cold moderator CNM for neutrons is arranged closely adjacent a thermal moderator TNM for neutrons. Both moderators CNM, TNM measure 12×12 cm in cross-section and are separated by a gap of 0.5 cm. Instead of a representation of an angular arrangement between the two moderators CNM, TNM their radiation directions CBL, TBL are indicated as being angular relative to each other. The cold moderator CNM emits a neutron spectrum having a maximum of cold neutrons CCN and a smaller proportion of thermal neutrons CTN. On the other hand, the thermal moderator TNM generates a maximum of thermal neutrons TTN and a lesser proportion of cold neutrons CTN. The thermal moderator TNM is arranged directly opposite a neutron guide NGT which conducts the coupled-in neutrons to a place of experiment not shown in FIG. 1. The neutron guide NGT has a cross-section of 6 cm×6 cm and extends from the neutron source also not shown in FIG. 1 by a distance of 32 m. For improving its reflective properties it is coated with nickel on its internal surface INS. By multiple flat reflection of acutely impinging neutron beams CCN, TTN it concentrates them in an effective mean radiation direction EBL to an overlapping neutron beam SBL having a multi spectrum. By attaining the effective mean radiation direction EBL, the neutrons impinge upon the probe to be analyzed quasi from one direction.

The overlapping neutron beam SBL generated in the neutron guide NGT by beam overlapping has a multi spectrum of particularly high value which is composed of from the maximum ranges of the spectra only of the two moderators CNM, TNM. To obtain such a purified multi spectrum which may be used with particular advantage for experiments in a broad energy range, further neutron-optical components NOC with an energy-dependent switching function are integrated into the neutron guide NGT at its end facing the two moderators CNM, TNM at a distance of 1.5 m therefrom. In the selected embodiment, these are a simple neutron conducting super reflector RSM and a further super reflector SSM opposite the first one. They arranged at an angle of 0.72° relative to the direction of the neutron guide NGT. So that the super reflector SSM reflects or passes impinging neutrons as a function of their kinetic energy. If a different angle is selected, the other dimensions of the participating components must be changes correspondingly. Both super reflectors RSM, SSM have a length of 6.5 m and are of commercial quality m=3, i.e. their sectional angle is thrice the sectional angle of natural nickel. The super reflector SSM is applied at a thickness of 0.75 mm to a neutron transparent Si substrate. Whereas the super reflector RSM serves merely to reflect emitting neutron beams, the opposite super reflector SSM fulfills an energy and angle depending switching function. In the selected example, the super reflector SSM is constructed and set in its angle (for instance 0.72° in this example) such that it reflects the cold neutrons CCN of the cold moderator CNM into the neutron guide NGT, whereas the cold neutrons CTN from the thermal moderator TNM are reflected away from the area of the neutron guide NGT by the other side of the reflector. In the opposite case, the thermal neutrons TCN of the cold moderator CNM are guided out of the neutron guide NGT along the super reflector SSM, whereas the thermal neutrons TTN from the thermal moderator TNM may unimpededly pass through the super reflector SSM. In this manner the overlapping neutron beam SBL is composed of preferentially emitted neutrons from both moderators CNM, TNM. This ensures on the one hand that at every neutron energy switching takes place to the moderator with the higher neutron flow and, on the other hand, that the other moderator with the possibly lesser beam quality—e.g. pulse shape in case of pulsed sources—are deflected out.

FIG. 2 depicts the switching function for generating the multi spectrum of the arrangement in accordance with the invention in exemplarily selected embodiment of FIG. 1. The relative transmission coefficient RTC of the entire neutron-optical system is shown as a function of the neutron wavelength NWL in nm for bother moderators CNM, TNM of FIG. 1 and may be defined as by comparison with the simple spectra in an identical neutron guide which is arranged at a distance of 1.5 m either ahead of the cold or ahead of the thermal moderator CNM, TNM. If neutron energy greater than 20 meV (this corresponds to a neutron velocity in excess of 2,000 m/sec or, by way of equivalence, to a neutron wavelength below 0.2 nm) are needed in an experiment, thermal neutrons TTN exclusively will be available in the combined multi spectrum. At neutron energies less than 5 meV (corresponding to a neutron velocity of less than 1,000 m/sec or, by way of equivalent, to a neutron wavelength of more than 0.4 nm) the supply of neutrons is satisfied with cold neutrons CCN almost exclusively from the cold moderator CNM. In a transitional range between 5 meV and 20 meV the neutrons TTN, CCN are fed in the overlapping neutron beam SBL to the experiment from both moderators TNM, CNM as a mixture with different proportions.

What is claimed is:

1. A neutron-optical component array for the specific spectral shaping of neutron beams or pulses in a neutron guide or in a radiation hole between a fast neutron source with a plurality of moderators of different structures arrayed closely together for generating slow neutrons of different energy spectra as well as for their radiation in predetermined radiation directions and at least one place of experiment, characterized by the fact that the radiation directions (CBL, TBL) of the moderators (CNM, TNM) are overlapped directly or by further neutron-optical components (RSM, SSM) in the neutron guide (NGT) or at the place of experiment and that the slow neutrons (CCN, TTN) generated by the moderators (CNM, TNM) of different energy spectra are integrated in common in an overlapping neutron beam (SBL) with a multi spectrum defined by the structure and number of the moderators (CNM, TNM).

2. The neutron-optical component array according to claim 1, characterized by the fact that in case of a direct overlapping of the radiation directions they are combinable by a predetermined encoding scheme at the place of experiment.

3. The neutron-optical component array according to claim 1, characterized by the fact that the neutron guide (NGT) is coated with nickel on its internal surface (INS).

4. The neutron-optical component array according to claim 1, characterized by the fact that in case of overlapping of the radiation directions by further neutron-optical components for obtaining an effective mean radiation direction of the overlapping neutron beam a further neutron-optical component is structured as an oscillating reflector which oscillated in synchronism with the pulsed neutron source or with the chopped neutron beam of a continuous neutron source.

5. The neutron-optical component array according to claim 1, characterized by the fact that in case of overlapping of the radiation directions (CBL, TBL) by further neutron-optical components (NOC) for obtaining an effective mean radiation direction (EBL) of the overlapping neutron beam (SBL) a further neutron-optical component (SSM) is provided with an energy dependent switching function.

6. The neutron-optical component array according to claim 5, characterized by the fact that the further neutron-optical component (NOC) is structured as a neutron reflector (SSM) with an energy dependent switching function which by a corresponding angular alignment continuously or intermittently passes or reflects impinging neutrons as a function of their energy.

7. The neutron-optical component array according to claim 5, characterized by the fact that the neutron reflectors (RSM, SSM) are structured in a self supporting form or in a form coated on a neutron transparent substrate as a single or multi-layered neutron reflector, with the coating being applied to one of both sides of the substrate.

8. The neutron-optical component array according to claim 4, characterized by the fact that the further neutron-optical components (NOC, RSM, SSM) are integrated into the neutron guide (NGT).

* * * * *